US006381304B1

(12) United States Patent
Shoenfeld et al.

(10) Patent No.: US 6,381,304 B1
(45) Date of Patent: Apr. 30, 2002

(54) MACHINABLE PLASTIC COMPENSATOR FILTER

(75) Inventors: Norman A. Shoenfeld, Livingston, NJ (US); Fred Sopenoff, Staten Island, NY (US)

(73) Assignee: S&S X-Ray Products, Inc., Brooklyn, NY (US)

( * ) Notice: Subject to any disclaimer, the term of this patent is extended or adjusted under 35 U.S.C. 154(b) by 0 days.

(21) Appl. No.: 09/640,142

(22) Filed: Aug. 17, 2000

(51) Int. Cl.[7] ..... G21K 3/00
(52) U.S. Cl. ..... 378/65; 378/18; 378/156
(58) Field of Search ..... 378/65, 64, 18, 378/156, 159

(56) References Cited

U.S. PATENT DOCUMENTS 3,678,233 A * 7/1972 Faw et al. ..... 378/158
5,014,290 A 5/1991 Moore et al. ..... 378/145
5,132,996 A * 7/1992 Moore et al. ..... 378/65
5,242,372 A * 9/1993 Carol ..... 378/159
5,528,650 A 6/1996 Swerdloff et al. ..... 378/65
5,724,403 A * 3/1998 Siochi et al. ..... 378/65
5,778,046 A * 7/1998 Molloi et al. ..... 378/159
6,094,474 A * 7/2000 Vezina ..... 378/159
6,125,165 A * 9/2000 Warburton et al. ..... 378/159

OTHER PUBLICATIONS

S&S Par Scientific, Inc., Digicut (TM) and Digimill (TM), product brochure, 1999.
Par Scientific, Radiotherapy State–of–the Art Effective Tissue Compensating Filters and Shielding Blocks, product brochure, 1999.

* cited by examiner

*Primary Examiner*—Drew Dunn
(74) *Attorney, Agent, or Firm*—Bernard P. Molldrem, Jr.

(57) ABSTRACT

A compensator filter is used to adjust the radiation therapy beam of a linear accelerator device to compensate for tissue that may have been removed surgically. The compensator filter is formed of a plastic material having a density of about one to two times that of the patient's tissue, and is disposed in the filter tray of the linear accelerator for selectively attenuating the radiotherapy beam to compensate for the missing tissue. Preferably, the filter can be made from a blank cast of polyurethane filled with glass microspheres, such that the filter is substantially free of heavy metal substances and toxic materials. The blank can be milled in a compensator filter milling machine of the type that is found in radiotherapy clinics.

12 Claims, 2 Drawing Sheets

MACHINABLE PLASTIC COMPENSATOR FILTER

BACKGROUND OF THE INVENTION

This invention relates to radiation therapy techniques, and is more especially related to filters that are employed with high energy radiation sources, such as linear accelerators, for selectively attenuating the beam to compensate for missing tissue, i.e., where a patient may have previously undergone extirpative surgery.

Radiation therapy is often used for treatment of malignancies, such as tumorous tissue, as an alternative to more invasive techniques such as surgery. That is, radiotherapy minimizes the discomfort to the patient and the risk of infection. In radiation therapy, a source of radiation external to the patient generates a beam that is directed at the tumor. However, even though this technique avoids some of the problems inherent with surgery, there is a danger of exposing non-tumorous, healthy tissue to a harmful level of radiation. The risk of this is reduced somewhat by irradiating the patient from a number of different gantry angles, and also by carefully collimating the therapy beam so that the dose falls mainly on the tumorous tissue.

Radiation therapy treatments have seen a rapid growth over the past decade, and the techniques to improve the accuracy and safety of these techniques have improved. For a patient having an area of missing tissue, as can occur following a radical extirpative surgical procedure, a compensator filter may be used in the beam of the radiation source. The compensator filter may be used to prevent overdosage of radiation in the tissues surrounding the area of the defect, and to provide a more uniform radiation treatment to the area being treated. The compensator filter has to be made up for each specific patient, and may have to be redone as the area of tumorous tissue shrinks as a result of treatment.

The compensator filter is typically formed by milling a blank of material on a milling machine, and then treating or filling the milled blank with an absorptive substance. In practice, the patient is first subjected to a scan of the area that is to be treated. This can be a direct laser scan that is specifically designed to image the tissue defects, or can be obtained from information obtained in a computed tomographic scan or magnetic resonance imaging (MRI) scan. This information may then be input into a treatment planning computer, which creates a plot for design of a filter to modify the radiation beam to adjust the dose in the area of the missing tissue. This information can be outputted to a computerized milling machine to create the compensator filter.

The most common technique of creating a filter involves milling a block of foamed polystyrene plastic in an inverse or negative configuration. Then, the block is removed from the machine, and placed under a hood in a mold room. A heated filter material, e.g., "Cerrobend", a liquid metal product that contains lead and cadmium, is poured into the foam block and is allowed to cool. Then the top surface of the Cerrobend material is milled away to remove the meniscus and create a flat top surface. The completed filter is then inserted in a filter holder on the linear accelerator (or other high-energy machine) so that it is the path of the beam between the source and the patient. The filter can be reused for the same patient over a series of therapy sessions.

This technique has a number of disadvantages. First, it contains heavy metals, notably lead and cadmium, which are toxic. The technician must be especially careful that all the dust removed from the filter during milling not enter the atmosphere where it could be breathed in. Also, the filter material itself cannot be simply discarded when the patient's treatment ends. Moreover, because the attenuation properties of this material are much greater than that of the patient's tissues involved, small thicknesses of the Cerrobend material are used. This limits the to degree of accuracy obtainable, as small changes in thickness can produce large changes in attenuation.

An alternative technique for creating a compensator filter involves milling an aluminum block. This avoids the toxicity problems of Cerrobend, but also requires a heavier milling machine than what is required for a foam plastic block, which increases the expense. Another alternative involves addition to the foam block of stainless steel in powder form, and the addition of a cover plate. There can also be a combination wax and metal form used, which is milled. However, because of its rather low attenuation characteristics, the filter is too thick for the filter holder.

OBJECTS AND SUMMARY OF THE INVENTION

Accordingly, it is an object of the present invention to provide a compensator filter for radiation therapy that avoids the drawbacks of the prior art.

It is another object to provide a compensator filter that is inexpensive and non-toxic, and which can compensate accurately for missing tissue without the filter being unduly thick.

It is a further object to provide a filter that can be created on a standard milling machine that is used for foam blocks, and which fits into a standard filter tray of a linear accelerator or other high-energy source.

It is still another object to provide a filter which is both inexpensive and safe to mill and to use, and which can be discarded as normal waste.

In accordance with an aspect of the present invention, a compensator filter is provided for a radiotherapy machine, such as a linear accelerator device, which emits a radiotherapy beam that is directed at a patient. A filter tray is disposed between the linear accelerator device and the patient, and the compensator filter is situated in the filter tray. The filter serves to attenuate the radiotherapy beam selectively, compensating for missing tissue that has been surgically removed from the patient. The filter is improved over the prior art in that it is formed of a non-toxic plastic material having a density of about 1 to 2 times that of the tissue of the patient, in terms of its ability to attenuate the radiotherapy beam. The material is free of heavy metal substances, such as lead or cadmium, and is disposable as ordinary trash.

In a preferred embodiment, the compensator filter is formed of a polyurethane with a fill of glass beads, which has a density of about 1.7 times that of normal human tissue.

The compensator filter can be created by first obtaining a filter pattern for the patient to compensate for tissue that has been surgically removed from the patient. This can be accomplished by direct laser scanning of the patient using a laser scanner that is specifically arranged for imaging tissue defects. Alternatively, the information can be obtained from either a computed tomography scan or a magnetic resonance imaging scan. This information is processed in a treatment planning computer to design the filter so that is modifies the therapy radiation beam to adjust the dose in the area of the missing tissue. Then the information is provided to a filter milling machine. A block of a machinable plastic material is milled according to the pattern, where said material has a density of about one to two times the density of the tissue of said patient. The plastic material is preferably an inert polymer, such as cast polyurethane resin, with a filler of a suitable glass material, such as beads or microspheres of silicon oxide and silicon dioxide.

As an alternative, the milling machine can form a negative mold for the filter, into which the resin material can be poured or cast, to create a molded plastic filler.

In either case, there is no toxic dust created in the milling process, and there is no need for any handling of toxic or dangerous materials in the creation, use, or disposal of the filter. The density of the material, i.e., 1.7 times that of water or human tissue, both allows the material to be milled accurately and also means that the filter will be thin enough to be used in a standard filter or shadow tray. No addition of absorptive materials (such as Cerrobend) is needed, nor is it necessary to use a hood or other precautions that are associated with the handling of toxic cadmium.

The above and many other objects, features, and advantages of this invention will become apparent from the ensuing description of a selected preferred embodiment, which is to be considered in connection with the accompanying Drawing.

DETAILED DESCRIPTION OF THE PREFERRED EMBODIMENT

Figure 1:
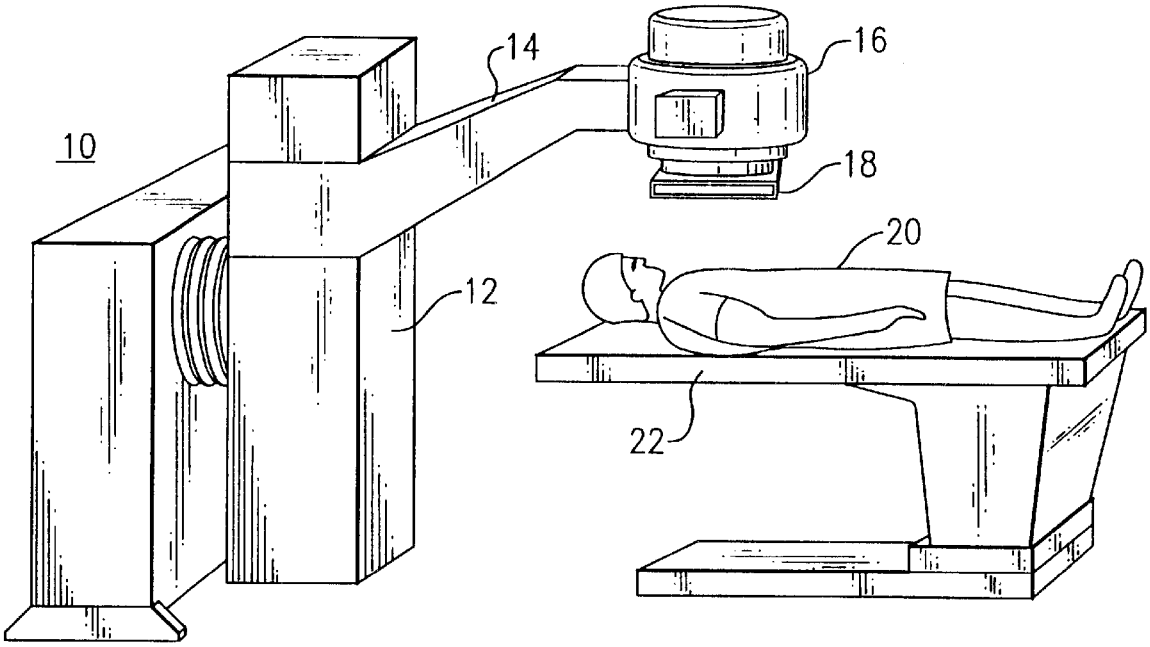
FIG. 1 is a perspective view of a linear accelerator or similar therapy machine with which the compensator filter of this invention is employed.

With reference to the Drawing, and initially to FIG. 1, a radiation therapy machine 10, which generates a high-energy therapy beam, is here shown with a gantry pillar 12 that can be rotated about a horizontal axis, and a gantry support 14 that is cantilevered from the pillar 12. A radiation generator head 16 is supported on the support 14 so that it can be positioned adjustably at any of various gantry angles and elevations. The head 16 can be for example a linear accelerator that generates a highly controllable high-energy beam, which as shown here would be projected downwards. A shadow tray 18 beneath the head 16 accepts various masks, collimators, and filters for modifying the beam according to the dose prescribed for a particular patient.

Figure 2:
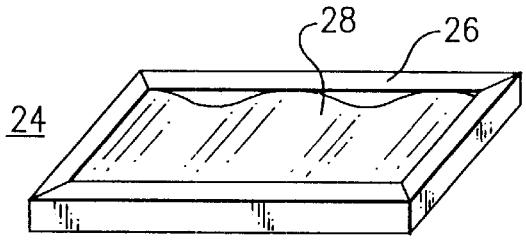
FIG. 2 is a perspective view of a compensator filter according to an embodiment of the invention.

A patient 20 is shown here positioned beneath the generator head 16 on a therapy table 22 so that the patient 20 is properly aligned with the machine 10. A prescribed dose may be applied to the patient 20 at one or several gantry angles, each of which may need modification by means of a compensation filter 24, an example of which is illustrated in FIG. 2. The filter 24 is dimensioned to fit on the shadow tray 18.

Figure 3:
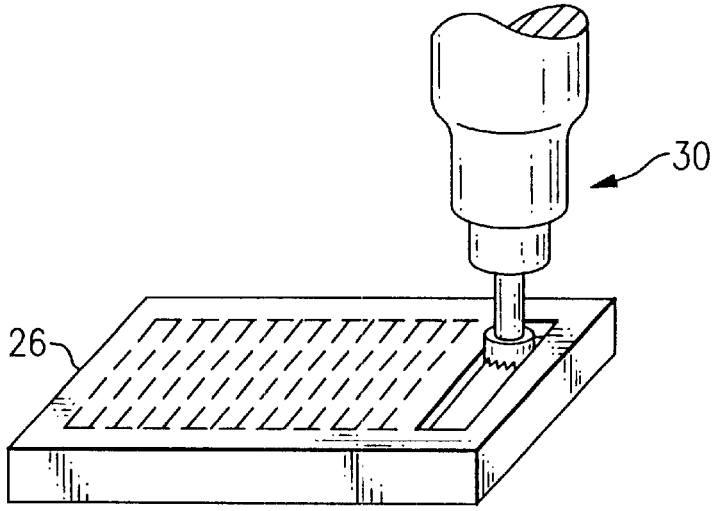
FIGS. 3 and 4 are perspective views for illustrating the techniques of this invention.

Often, the patient 20 may have been subjected to extirpative surgery, e.g., to remove tumorous tissue from the affected area. When that is the case, the beam has to be modified to limit the dose to protect surrounding healthy tissue. To accomplish this, a scan of the affected area of the patient 20 is carried out, either using a laser scan technique, or using a computerized tomographic scan or a magnetic resonance imaging scan. Then the information is furnished to a planning computer to plot the shape of the filter that will be needed to modify the beam and compensate for the missing tissue. This information can be transmitted to a milling machine. A block of a cast polyurethane resin 26 is inserted into the milling machine, and material is removed leaving a contoured central region 28. As illustrated in FIG. 3, a milling head 30 of the milling machine moves in a programmed fashion to remove the material from the cast block or blank 26. In the preferred embodiment the block 26 is a machinable polyurethane resin having a fill of glass microspheres, i.e., silicon oxide and silicon dioxide. This material has the advantage of being rather inert and non-toxic, therefore making it safe for handling and for disposal, and avoiding problems from contact with dust, shavings or other milling byproducts. The glass-filled urethane material also has desirable absorptive properties, having a density of about one to two times that of human tissues, that is attenuating the therapy beam about one to two times as strongly as tissue, i.e, as water. In this embodiment, the density is about 1.7. The material should be machinable in milling machine of the kind typically found in radiation therapy clinics. An example of such milling machine is the Digimill (TM) automatic compensator milling machine, from S&S Par Scientific, Inc. Other milling machines are also available.

Figure 4:
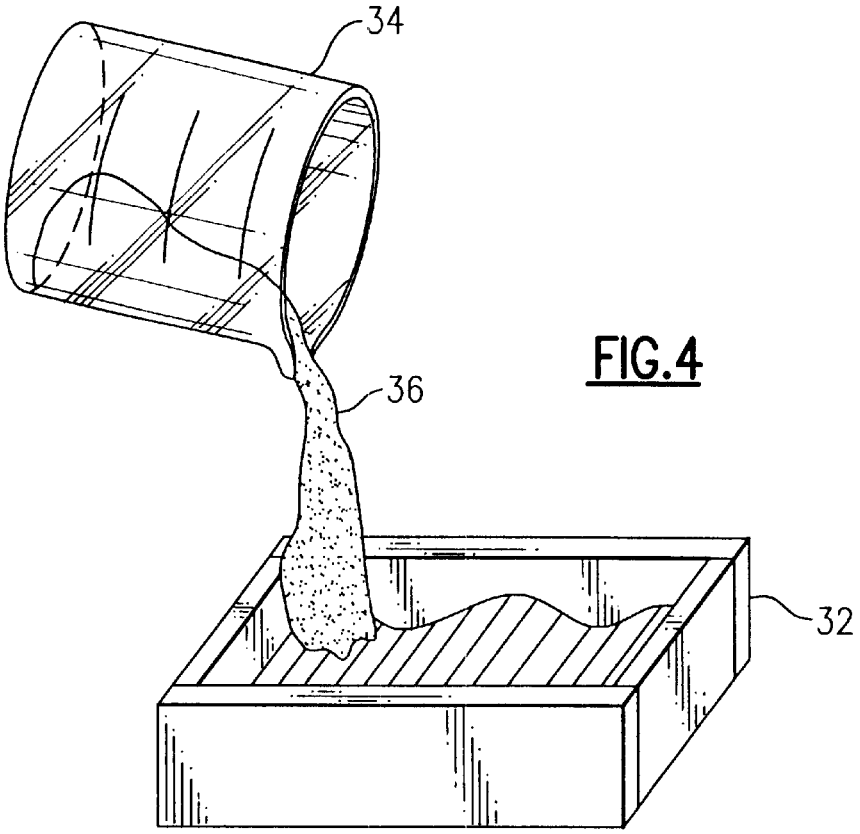

As an alternative to the compensator filter 24 of FIG. 2, it is also possible to create an inverse or negative intermediate form or mold on the milling machine, and then fill the intermediate with a softened resin. When the resin hardens, it can be removed from the intermediate to yield a cast plastic compensator filter. The plastic resin material can be polyurethane with glass particle (microsphere) filler. As shown in FIG. 4, after the negative mold 32 has been prepared, it can be filled by decanting the softened resin material 36 into it from a suitable vessel 34. After the material is sufficiently hardened, the filter can be removed from the mold 32.

While the invention has been described hereinabove with reference to selected preferred embodiments, it should be recognized that the invention is not limited to those precise embodiment. Rather, many modification and variations would present themselves to persons skilled in the art without departing from the scope and spirit of this invention, as defined in the appended claims.

We claim:

1. In combination:

a linear accelerator device which emits a radiotherapy beam that is directed at a patient;

a filter tray disposed between said linear accelerator device and said patient; and a compensator filter disposed in said filter tray for selectively attenuating said radiotherapy beam to compensate for missing tissue that has been surgically removed from said patient;

comprising the improvement wherein said filter is formed of a machinable plastic material containing only substantially inert, non-toxic components and having a density of about 1 to 2 times that of the tissue of the patient, in respect to said radiotherapy beam, such that the filter is precisely machined to match the absorptiveness of said missing tissue.

2. The combination of claim 1 wherein said filter is substantially free of toxic metal substances.

3. The combination of claim 2 wherein said plastic material is substantially free of toxic materials.

4. A method of forming a compensator filter for a radiotherapy machine that generates a radiotherapy beam for treating a patient, comprising a) obtaining a filter pattern for said patient to compensate for tissue that has been surgically removed from the patient; and b) machining a block of a machinable plastic material according to the pattern, wherein said machinable plastic material contains only substantially inert, non-toxic material and has a density of about one to two times the density of the tissue of said patient, in respect to said radiotherapy beam.

5. The method of claim 4, wherein said plastic material consists essentially of an inert plastic polymer and a filler of glass particles.

6. The method of claim 4, wherein said plastic material consists essentially of polyurethane and a filler of glass beads.

7. The method of claim 4 wherein said material has a density of substantially 1.7.

8. Method of forming a compensator filter for a radiotherapy machine that generates a radiotherapy beam for treating a patient, comprising a) obtaining a filter pattern for said patient to compensate for tissue that has been surgically removed from the patient;

b) machining a block of a mold material according to said pattern, said mold material consisting of substantially inert, non-toxic materials; and c) filling said mold with a moldable plastic material to create said compensator filter, wherein said moldable plastic material has a density of about one to two times that of the tissue of said patient in respect to said radiotherapy beam.

9. The method of claim 8, wherein said material consists essentially of an inert polymer and a filler of glass particles.

10. The method of claim 8, wherein said plastic material consists essentially of polyurethane and a filler of glass beads.

11. The method of claim 8, wherein said plastic material has a density of substantially 1.7.

12. The method of claim 8, wherein said plastic material is substantially free of toxic substances.

* * * * *

UNITED STATES PATENT AND TRADEMARK OFFICE

CERTIFICATE OF CORRECTION

PATENT NO. : 6,381,304 B1
DATED : April 30, 2002
INVENTOR(S) : Norman Shoenfeld et al.

It is certified that error appears in the above-identified patent and that said Letters Patent is hereby corrected as shown below:

Column 2,
Line 7, the word "to" should be deleted

Signed and Sealed this

Twenty-fifth Day of June, 2002

*Attest:*

*Attesting Officer*

JAMES E. ROGAN
*Director of the United States Patent and Trademark Office*